US008038811B2

(12) United States Patent
Oka

(10) Patent No.: US 8,038,811 B2
(45) Date of Patent: Oct. 18, 2011

(54) PROCESS FOR PRODUCING BENT PIPE FOR LINE PIPE

(75) Inventor: Takahiro Oka, Osaka (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 72 days.

(21) Appl. No.: 12/565,254

(22) Filed: Sep. 23, 2009

(65) Prior Publication Data

US 2010/0006190 A1 Jan. 14, 2010

Related U.S. Application Data

(63) Continuation of application No. PCT/JP2008/055107, filed on Mar. 19, 2008.

(30) Foreign Application Priority Data

Mar. 26, 2007 (JP) ..... 2007-078705

(51) Int. Cl.
*C21D 9/08* (2006.01)
*C22C 38/02* (2006.01)
*C22C 38/04* (2006.01)

(52) U.S. Cl. ..... 148/592; 148/325

(58) Field of Classification Search ..... 148/325, 148/592

See application file for complete search history.

(56) References Cited

U.S. PATENT DOCUMENTS

2005/0034796 A1 2/2005 Tanida

FOREIGN PATENT DOCUMENTS

| | | | | |
|---|---|---|---|---|
| EP | 1826285 | A1 | | 8/2007 |
| EP | 1876253 | A1 | | 1/2008 |
| EP | 2060644 | A1 | | 5/2009 |
| JP | 61-7019 | | | 1/1986 |
| JP | 07018331 | A | * | 1/1995 |
| JP | 3156170 | | | 2/2001 |
| JP | 2002-30392 | | | 1/2002 |
| JP | 2002-129288 | | | 5/2002 |
| JP | 2003-3243 | | | 1/2003 |
| JP | 2004-2999 | | | 1/2004 |
| WO | 2006054430 | A1 | | 5/2006 |

* cited by examiner

*Primary Examiner* — Jessica L Ward
*Assistant Examiner* — Alexander Polyansky
(74) *Attorney, Agent, or Firm* — Clark & Brody

(57) ABSTRACT

A steel pipe is prepared, which contains, by mass, at most 0.009% C, at most 1.0% Mn, at most 1.0% Si, at most 0.04% P, at most 0.005% S, 0.01 to 0.2% Ti, 0.01 to 0.10% V, 0.001 to 0.1% Al, at most 0.1% N, 4.0 to 8.0% Ni, 9.0 to 15.0% Cr, and 1.5 to 7.0% Mo, the balance being Fe and impurities. The prepared steel pipe is bent into a bend pipe. The bend pipe is quenched at a quenching temperature lower than 950° C. The quenched bend pipe is tempered. Accordingly, the bend pipe in accordance with the present invention has excellent SSC resistance.

1 Claim, No Drawings

PROCESS FOR PRODUCING BENT PIPE FOR LINE PIPE

"This application is a continuation of International Patent Application No. PCT/JP2008/055107, filed Mar. 19, 2008. This PCT application was not in English as published under PCT Article 21(2)."

TECHNICAL FIELD

The present invention relates to a process for producing a bend pipe and the bend pipe. More particularly, it relates to a process for producing a bend pipe used for a line pipe and the bend pipe for a line pipe.

BACKGROUND ART

A pipeline transports oil and natural gas produced from an oil well and a gas well. Conventionally, a carbon steel has been used mainly for a steel pipe (line pipe) constituting a pipeline.

In recent years, however, as the well depth increases, portions known as a gathering line and a flow line of the line pipe are likely to be exposed to a corrosive environment having higher temperature and pressure than the conventional environment. Also, these portions must transport a produced fluid containing corrosive gases such as hydrogen sulfide gas and carbonic-acid gas. Therefore, the line pipe used for the gathering line and flow line is increasingly required to have excellent carbonic-acid gas corrosion resistance and sulfide stress-corrosion cracking resistance (hereinafter, sulfide stress-corrosion cracking is referred to as SSC).

In this situation, a martensitic stainless steel pipe for a line pipe has been developed as a steel pipe that meets the above-described requirement. The martensitic stainless steel pipe for a line pipe has been disclosed, for example, in JP3156170B.

The martensitic stainless steel pipe for a line pipe is provided with excellent carbonic-acid gas corrosion resistance and SSC resistance by forming a passivation film on the surface thereof by the addition of Mo and making the C content lower than 0.01%. Also, by containing a large amount of Ni as an austenite forming element substituting for C, the micro-structure can be kept martensitic even if the C content is low. Further, since the C content is low, work hardening is less liable to occur at the time of welding, and excellent weldability is demonstrated. Therefore, the martensitic stainless steel pipe for a line pipe is suitable to the use for the gathering line and flow line.

The pipeline includes not only a straight line pipe (so called a straight pipe) but also a line pipe having a curved portion, that is, a bend pipe according to the geographical features of the ground on which the pipeline is laid.

A general process for producing a bend pipe consisting of carbon steel, which has been used for the conventional pipeline, is described below. First, a straight pipe is bent at a high temperature into a bend pipe. Subsequently, the bend pipe is quenched and tempered. Since the mechanical properties such as strength and toughness of the bend pipe are deteriorated by the bending at a high temperature, the mechanical properties are improved by quench and temper.

As the well depth increases in recent years as described above, the martensitic stainless steel for a line pipe has begun to be used for the gathering line and flow line in place of carbon steel. Therefore, in place of the conventional bend pipe consisting of carbon steel, demand emerges for the bend pipe consisting of the martensitic stainless steel for a line pipe.

However, in the case where the bend pipe consisting of the martensitic stainless steel for a line pipe is produced in the same producing condition as that of the conventional bend pipe consisting of carbon steel, the SSC resistance of the produced bend pipe is sometimes low.

DISCLOSURE OF THE INVENTION

An object of the present invention is to provide a process for producing a bend pipe for a line pipe, which bend pipe consists of martensitic stainless steel and has excellent SSC resistance, and the bend pipe.

The inventor investigated a cause of the decrease in the SSC resistance of the bend pipe for a line pipe consisting of martensitic stainless steel. As the result of investigation, the inventor thought that the tempering temperature in quenching and tempering treatment after bending has an influence on the decrease in SSC resistance. Therefore, the bend pipes were produced at various quenching temperatures. As a result, it has been found that if the quenching temperature is lower than 950° C., the produced bend pipe has excellent SSC resistance.

The present invention was completed based on the above-described knowledge, and the gists thereof are as described below.

A process for producing a bend pipe for a line pipe in accordance with the present invention includes the steps of preparing a steel pipe containing, by mass, at most 0.009% C, at most 1.0% Mn, at most 1.0% Si, at most 0.04% P, at most 0.005% S, 0.01 to 0.2% Ti, 0.01 to 0.10% V, 0.001 to 0.1% Al, at most 0.1% N, 4.0 to 8.0% Ni, 9.0 to 15.0% Cr, and 1.5 to 7.0% Mo, the balance being Fe and impurities; bending the steel pipe into a bend pipe; quenching the bend pipe at a quenching temperature lower than 950° C.; and tempering the quenched bend pipe.

A bend pipe for a line pipe in accordance with the present invention contains, by mass, at most 0.009% C, at most 1.0% Mn, at most 1.0% Si, at most 0.04% P, at most 0.005% S, 0.01 to 0.2% Ti, 0.01 to 0.10% V, 0.001 to 0.1% Al, at most 0.1% N, 4.0 to 8.0% Ni, 9.0 to 15.0% Cr, and 1.5 to 7.0% Mo, the balance being Fe and impurities. The bend pipe for a line pipe in accordance with the present invention is further characterized by being quenched at a quenching temperature lower than 950° C. after bending.

BEST MODE FOR CARRYING OUT THE INVENTION

An embodiment of the present invention will now be described in detail.

1. Chemical Composition of a Bend Pipe for a Line Pipe

The bend pipe for a line pipe consists of martensitic stainless steel, and the chemical composition thereof is as described below. Hereunder, the symbol % relating to an element means percent by mass.

C: at most 0.009%

Carbon (C) increases the hardness of a welding heat affected zone (HAS) at the time of welding, and decreases the toughness and corrosion resistance of steel. Therefore, the C content is preferably as low as possible. The C content is at most 0.009%.

Mn: at most 1.0%

Manganese (Mn) improves the strength of steel. However, if manganese is contained excessively, the toughness decreases. Therefore, the Mn content is at most 1.0%. The preferred Mn content is at least 0.2%.

Si: at most 1.0%

Silicon (Si) deoxidizes a steel. However, if the Si content exceeds 1.0%, the toughness of steel decreases. Therefore, the Si content is at most 1.0%. The preferred Si content is at least 0.05%.

P: at most 0.04%

Phosphorus (P) is an impurity. Phosphorus decreases the toughness of steel. Therefore, the P content is preferably as low as possible. The P content is at most 0.04%.

S: at most 0.005%

Sulfur (S) is an impurity. Sulfur decreases the hot workability of steel. Therefore, the S content is preferably as low as possible. The S content is at most 0.005%.

Ti: 0.01 to 0.2%

V: 0.01 to 0.10%

Titanium (Ti) and vanadium (V) restrain the rise in hardness of the welding heat affected zone at the time of welding by forming a carbo-nitride with N and C in the steel. However, if these elements are contained excessively, the effect saturates. Further, these elements increase the hardness by forming a compound with an element such as Ni. Therefore, the Ti content is 0.01 to 0.2%, and the V content is 0.01 to 0.10%. The preferred Ti content is 0.05 to 0.15%, and the preferred V content is 0.02 to 0.10%.

Al: 0.001 to 0.1%

Aluminum (Al) deoxidizes a steel. However, if aluminum is contained excessively, the inclusions in the steel increase, and the corrosion resistance of steel decreases. Therefore, the Al content is 0.001 to 0.1%.

N: at most 0.1%

Nitrogen (N) is an impurity. Nitrogen enhances the SSC sensitivity. Therefore, the N content is preferably lower. The N content is at most 0.1%. The preferred N content is at most 0.02%.

Ni: 4.0 to 8.0%

Nickel (Ni) improves the strength, corrosion resistance, and hot workability of steel. However, if nickel is contained excessively, the effect saturates. Therefore, the Ni content is 4.0 to 8.0%.

Cr: 9.0 to 15.0%

Chromium (Cr) forms a corrosion-resistant film, and improves the corrosion resistance of steel. However, if chromium is contained excessively, ferrite is produced by the synergetic effect with Mo, and thereby the strength is decreased. Therefore, the Cr content is 9.0 to 15.0%.

Mo: 1.5 to 7.0%

Molybdenum (Mo) improves the resistance to corrosion caused by hydrogen sulfide. In particular, it improves the corrosion resistance of welding heat affected zone. However, if molybdenum is contained excessively, ferrite is produced by the synergetic effect with Cr, and thereby the strength is decreased. Therefore, the Mo content is 1.5 to 7.0%. The preferred Mo content is 2.0 to 7.0%.

The balance consists of Fe and impurities.

2. Process for Producing the Bend Pipe

Hereunder, an example of a process for producing the bend pipe is explained. The process for producing the bend pipe includes a step of preparing a straight steel pipe for a line pipe (steel pipe preparing step), a step for bending the straight steel pipe for a line pipe (bending step), a step of quenching the bent steel pipe (bend pipe) (quenching step), and a step of tempering the quenched bend pipe (tempering step). Hereunder, these steps are explained.

[Steel Pipe Preparing Step]

A steel pipe for a line pipe having the above-described chemical composition is prepared. The steel pipe for a line pipe is manufactured, for example, by a method described below. A molten steel having the above-described chemical composition is cast into billets by the continuous casting process. The manufactured billet is piercing-rolled to form a steel pipe for a line pipe. In the above-described process, a seamless steel pipe is manufactured as a steel pipe for a line pipe. However, a welded pipe may be manufactured by welding using various welding methods including submerged arc welding (SAW), metal inert gas welding (MIG), and tungsten inert gas welding (TIG).

[Bending Step]

The prepared straight steel pipe for a line pipe is bent to form a bend pipe. As one example of bending work, bending work by high-frequency heating is explained below.

The straight steel pipe for a line pipe is inserted into a high-frequency coil. One end of the steel pipe for a line pipe inserted into the high-frequency coil is held by an arm (bending arm) rotating horizontally. Thereafter, the steel pipe for a line pipe is pushed in gradually in the pipe axis direction from the other end of steel pipe. By the pushing-in of steel pipe, the bending arm is rotated, and thereby the steel pipe is bent gradually while being heated partially by the high-frequency coil. At the time of bending, a portion heated by the high-frequency coil of the steel pipe has a temperature in the range of 930 to 970° C.

In the above description, the bending work by high-frequency heating has been explained. However, the bend pipe may be produced by any other hot bending work.

[Quenching Step]

The quenching step is the most important step in the present invention. In the present invention, the quenching temperature is lower than 950° C. If the quenching temperature is 950° C. or higher, the SSC resistance of bend pipe after quench and temper decreases, and SSC occurs. The reason for this is not clear. However, it is presumed that when the bend pipe having the above-described chemical composition is soaked at a quenching temperature of 950° C. or higher, a secondary product is generated in the steel, and this secondary product decreases the SSC resistance. The generated secondary product is not obvious. However, a Laves phase compound such as $Fe_2Mo$ is thought of. Therefore, the quenching temperature is lower than 950° C. The preferred quenching temperature is at most 945° C., and the further preferred quenching temperature is at most 940° C.

On the other hand, if the quenching temperature is too low, a necessary strength cannot be obtained. Therefore, the quenching temperature is at least 800° C. The preferred quenching temperature is at least 850° C., and the further preferred quenching temperature is at least 890° C. The preferred soaking time is 45 minutes or longer, and the further preferred soaking time is 50 to 60 minutes.

The bend pipe soaked at the aforementioned quenching temperature is cooled to room temperature at a well-known cooling rate. The cooling method may be water cooling or mist cooling.

[Tempering Step]

After being quenched, the bend pipe is tempered by the well-known tempering method. The tempering temperature is, for example, 600 to 700° C., and the preferred soaking time is 45 to 60 minutes.

The bend pipe for a line pipe produced through the above-described manufacturing steps has excellent SSC resistance. The yield strength of the bend pipe quenched and tempered under the above-described conditions is 550 to 725 MPa.

EXAMPLE

A martensitic stainless steel having the chemical composition given in Table I was melted, and the molten steel was cast in to a plurality of round billets.

TABLE 1

| Chemical composition (unit: mass %, balance being Fe and impurities) | | | | | | | | | | | |
|---|---|---|---|---|---|---|---|---|---|---|---|
| C | Mn | Si | P | S | Ti | V | Al | N | Ni | Cr | Mo |
| 0.008 | 0.45 | 0.38 | 0.014 | 0.0007 | 0.085 | 0.05 | 0.005 | 0.0066 | 6.38 | 11.86 | 2.56 |

The manufactured round billets were piercing-rolled to produce a plurality of straight seamless steel pipes. The seamless steel pipes were bent by high-frequency heating to produce a plurality of bend pipes. At this time, the temperature of high-frequency heating was 950° C.

The bend pipes were quenched and tempered at the quenching temperature and tempering temperature given in Table 2, and bend pipes for a line pipe each having an outside diameter of 219.1 mm, a wall thickness of 12.7 mm, and a radius of curvature of bend portion of 5DR were produced.

TABLE 2

| Test No. | Quenching temperature (° C.) | Tempering temperature (° C.) | YS (MPa) | TS (MPa) | SSC |
|---|---|---|---|---|---|
| 1 | 900 | 640 | 589 | 932 | Absent |
| 2 | 950 | 650 | 591 | 928 | Present |
| 3 | 925 | 645 | 613 | 925 | Absent |
| 4 | 900 | 640 | 554 | 913 | Absent |

The quenching temperatures for the bend pipes of test Nos. 1, 3 and 4 were in the range of the present invention. On the other hand, the quenching temperatures for the bend pipe of test No. 2 exceeded the upper limit of the present invention.

[Tensile Test]

Tensile specimens were cut from the bend pipes of test Nos. 1 to 4, and a tensile test was performed. Specifically, a round bar specimen having an outside diameter of parallel part of 8.9 mm was cut from each of the bend pipes. On the cut round bar specimens, a tensile test was performed at normal temperature. The yield strength (MPa) obtained by the tensile test is shown in the "YS" column in Table 2, and the tensile strength (MPa) is shown in the "TS" column in Table 2. As the result of the tensile test, all of the yield strengths of the bend pipes of test Nos. 1 to 4 were in the range of 550 to 725 MPa.

[SSC Test]

An unnotched four-point bending specimen having a width of 10 mm, a thickness of 2 mm, and a length of 75 mm was cut from each of the bend pipes. By using the cut four-point bending specimen, a four-point bending test was performed in a test fluid containing hydrogen sulfide. Specifically, as the test fluid, an aqueous solution (Solution A specified in NACE-TM0177) containing 5 mass % of NaCl and 0.5 mass % of glacial acetic acid ($CH_3COOH$) was prepared. The stress applied to the four-point bending specimen during the test was an actual yield stress of 90% in the strain gage method. Also, during the test, a mixed gas composed of $H_2S$ gas with a partial pressure of 0.004 (bar) and $CO_2$ gas with a partial pressure of 0.996 (bar) was blown into the test fluid. The test temperature was 25±1° C., and the test time was 720 hours.

After the test, the occurrence of SSC on the test piece was visually observed. The term "Present" in the "SSC" column in Table 2 indicates that SSC occurred, and the term "Absent" indicates that SSC did not occur.

Referring to Table 2, for test Nos. 1, 3 and 4, SSC did not occur because the quenching temperature was in the range of the present invention. On the other hand, for test No. 2, SSC occurred because the quenching temperature exceeded the upper limit of the present invention.

The above is an explanation of one embodiment of the present invention. The above-described embodiment is only an example for carrying out the present invention. Therefore, the present invention is not limited to the above-described embodiment, and the above-described embodiment can be modified or changed appropriately without departing from the spirit and scope of the present invention.

INDUSTRIAL APPLICABILITY

The bend pipe for a line pipe in accordance with the present invention can be used for a line pipe.

The invention claimed is:

1. A process for producing a bent pipe for a line pipe, comprising the steps of:

preparing a straight steel pipe containing, by mass, at most 0.009% C, at most 1.0% Mn, at most 1.0% Si, at most 0.04% P, at most 0.005% S, 0.01 to 0.2% Ti, 0.01 to 0.10% V, 0.001 to 0.1% Al, at most 0.1% N, 4.0 to 8.0% Ni, 9.0 to 15.0% Cr, and 1.5 to 7.0% Mo, the balance being Fe and impurities;

bending the straight steel pipe into a bent pipe;

quenching the bent pipe at a quenching temperature of 850° C. to lower than 950° C.; and tempering the quenched bent pipe at a tempering temperature of 600° C. to 700° C. to produce the bent pipe having a yield strength of 550 MPa to 725 MPa.

* * * * *